US010561185B2

(12) United States Patent
Harris

(10) Patent No.: US 10,561,185 B2
(45) Date of Patent: Feb. 18, 2020

(54) TOOL FOR SIMULTANEOUSLY ATTACHING MULTIPLE HAIR EXTENSIONS

(71) Applicant: Jessica Harris, Los Banos, CA (US)

(72) Inventor: Jessica Harris, Los Banos, CA (US)

( * ) Notice: Subject to any disclaimer, the term of this patent is extended or adjusted under 35 U.S.C. 154(b) by 540 days.

(21) Appl. No.: 15/279,349

(22) Filed: Sep. 28, 2016

(65) Prior Publication Data

US 2018/0084854 A1 Mar. 29, 2018

(51) Int. Cl.
*A41G 3/00* (2006.01)
*A41G 5/00* (2006.01)

(52) U.S. Cl.
CPC ..... *A41G 5/0086* (2013.01); *A41G 5/008* (2013.01)

(58) Field of Classification Search
CPC .... A41G 5/0086; A41G 5/008; A41G 5/0053; B29C 65/02; B29C 65/022; B29C 65/026; B29C 65/18; B29C 65/20; A45D 1/14; A45D 1/12; A45D 2002/005; A45D 2/40; A45D 2/42; A01K 13/00; A01K 13/003; A01K 13/005
See application file for complete search history.

(56) References Cited

U.S. PATENT DOCUMENTS 1,486,786 A * 3/1924 Morenilla ..... A45D 1/12 132/224
2,377,877 A * 6/1945 Graham ..... A45D 2/42 132/223
5,072,745 A 12/1991 Cheh
5,121,761 A 6/1992 Meister
5,934,293 A * 8/1999 Kaizuka ..... A45D 1/12 132/224
6,510,856 B1 1/2003 Ahn
6,938,624 B2 9/2005 Arroyo et al.
7,296,581 B2 11/2007 Gold
7,753,057 B2 7/2010 Kallabat et al.
8,844,541 B2 9/2014 Guliker
8,967,159 B1 * 3/2015 Jenkins ..... A45D 2/001 132/223
9,439,465 B2 * 9/2016 Ott ..... A41G 5/008
2004/0173233 A1 9/2004 Tokko
(Continued)

FOREIGN PATENT DOCUMENTS

EP 0876773 A1 11/1998

*Primary Examiner* — Nicholas D Lucchesi
(74) *Attorney, Agent, or Firm* — Morgan, Lewis & Bockius LLP

(57) ABSTRACT

A hair extension tool simultaneously attaches multiple hair extensions to a recipient's hair. The tool has upper and lower handles that are mechanically coupled in a parallel orientation. The handles are moveable, and the coupling has a quiescent state in which the handles are spaced apart. The tool includes an upper arc and a lower arc that have substantially the same shape. The upper and lower arcs are attached to the handles on their convex sides. The upper arc includes multiple teeth, and each tooth has a substantially semicircular concave opening. The lower arc includes teeth that fit into the openings in the teeth of the upper arc when the upper and lower handles are brought together. Each tooth in the lower arc includes a groove for holding a group of strands of the recipient's hair. The upper arc includes a heating element that is activated by a button.

20 Claims, 10 Drawing Sheets

(56) References Cited

U.S. PATENT DOCUMENTS

| | | | | |
|---|---|---|---|---|
| 2006/0011208 | A1* | 1/2006 | Johns | A45D 1/04 132/213.1 |
| 2006/0169296 | A1 | 8/2006 | Gill et al. | |
| 2008/0223390 | A1* | 9/2008 | Brown | A41G 5/0046 132/201 |
| 2008/0236605 | A1 | 10/2008 | Russo | |
| 2017/0231350 | A1* | 8/2017 | Moore | A45D 2/40 132/224 |
| 2018/0070665 | A1* | 3/2018 | Ott | A41G 5/008 |
| 2018/0289093 | A1* | 10/2018 | Ge | A45D 44/02 |

* cited by examiner 500 (magnified)

TOOL FOR SIMULTANEOUSLY ATTACHING MULTIPLE HAIR EXTENSIONS

TECHNICAL FIELD

The disclosure relates generally to hair extensions, and more specifically to handheld tools for attaching hair extensions to a person's existing hair.

BACKGROUND

As beauty consciousness grows among people of all ages, an increasing number of men and women feel the need to look their best at all times. Hair styles serve as important part of a persona, because they are simultaneously public (visible to everyone), personal (biologically linked to the body), and highly malleable to suit cultural and personal preferences.

One way of enhancing the look of a particular hairstyle is by using hair extensions. Hair extensions, also known as "weft hair extensions," add length and/or fullness to human hair. Extensions are a way to lengthen a person's hair by incorporating artificial hair or natural hair (collected from other individuals or from a person's own hair). There are many reasons men and women use extensions. Sometimes people desire longer hair or a greater volume of hair than they naturally have. Others gradually go bald, or have receding hair lines. A person may get a haircut and regret it later. Some people have difficulty growing hair beyond a certain length. Hair extensions can help them reach their desired length. Some people who do not want to damage their own natural hair with dye use hair extensions to add streaks of color.

Current methods for temporary hair augmentation include sew-ins, gluing, hair fusion, hair tape, metal coils, rubber bands, and hair clips. Each of these methods has substantial drawbacks, however. Attaching hair extensions using the sew-in method is a painful and painstaking process that involves a needle and thread to join hair extensions to a person's natural hair. Often, the needle pricks the scalp during the process of hair extension, and it is very time consuming. Gluing and hair fusion are similarly time consuming. These processes involve attaching small groups of hair to a person's own hair with a fixative. Hair tape is a fairly quick method of hair augmentation, but is not very reliable. For example, when a person's natural hair is oily, the adhesion is not very good. Metal coils and rubber bands are other time consuming hair augmentation methods that involve the addition of small quantities of hair to small clusters of a person's own hair. These methods involve pulling a person's natural hair at its roots, which is slow and risks loss of hair. Hair clips can be used to attach hair extensions quickly, and can be done by a person without going to a salon. However, hair clips are generally removed prior to going to bed because they are uncomfortable for sleeping. Because of this, the process has to be repeated daily.

SUMMARY

Hair fusion using an adhesive is one technique that can create long-term results. However, the time required to attach a large number of individual extensions make the process too time consuming and/or too expensive for many people. A stylist at a salon may need three to six hours to attach the extensions. In addition, because the extensions are attached individually, it creates non-uniformity in size and/or placement of the extensions.

The present application discloses hair extension tools that enable a stylist to attach many hair extensions simultaneously, which creates greater uniformity for the extensions and enables the stylist to complete the process in a much shorter time.

In accordance with some implementations, a hair extension tool is used for simultaneously attaching a plurality of hair extensions to a recipient's hair. The tool has an upper handle and a lower handle that are mechanically coupled to each other in a parallel orientation. The upper and lower handles are moveable with respect to each other, and the mechanical coupling maintains the parallel orientation of the two handles when moved with respect to each other. The mechanical coupling has a default quiescent state in which the upper and lower handles are spaced apart (e.g., based on spring action). The tool also has an upper arc and a lower arc. The upper and lower arcs have the same arc shape (e.g., the same radius of curvature). The upper arc is attached to the upper handle on the convex side of the upper arc, and the lower arc is attached to the lower handle on the convex side of the lower arc. In some implementations, the upper arc includes a first plurality of teeth, where each tooth of the first plurality has a semicircular concave opening. In some implementations, the semicircular openings have a shape that is substantially like the opening in the capital Greek letter omega Ω. In some implementations, the upper arc includes a plurality of semicircular openings without dividing the openings into individual teeth. The lower arc includes a second plurality of teeth that fit into the semicircular concave openings of the first plurality of teeth in the upper arc when the upper and lower handles are brought together (e.g., by user action). Each tooth of the second plurality includes a groove for holding a group of strands (e.g., a tuft) of the recipient's hair. In some implementations, each groove in the second plurality of teeth is formed by a respective pair of vertical prongs. The upper arc includes a heating element that is activated by a button on the upper handle or the lower handle. In some implementations, there is a heating element in the lower arc as well. When there is a heating element in the lower arc, implementations typically activate the lower arc heating element with the same button. Some implementations provide a separate heating element button for the lower arc heating element.

In some implementations, the upper arc is an integrally formed portion of the upper handle, and the lower arc is an integrally formed portion of the lower handle. For example, the upper handle and upper arc may be cast as a single element during construction or connected together permanently during construction.

In some implementations, the upper and lower arcs are detachable from the upper and lower handles. In some instances, this enables a user to clean or disinfect the arcs that come into direct contact with a user's hair without the need to clean the entire tool. In some circumstances, a stylist may have multiple sets of the arcs, and may switch sets of arcs (even for a single hair extension recipient). In some circumstances, the stylist switches which arcs are used based on different portions of a recipient's scalp having a different shape or differing amounts of natural hair. In some instances, a stylist may switch arcs if a set becomes sticky from the adhesive. (Typically the non-stick surfaces avoid this problem.)

In some implementations, a user has several sets of arcs that are different, and a stylist may choose an appropriate set of arcs based on the person seeking hair extensions. For example, some implementations include a second pair of matching arcs that have pairs of teeth (upper and lower) that are spaced further apart than the teeth in the (first) upper and lower arcs. In some implementations, a second pair of matching arcs has fewer teeth than the teeth in the first set of arcs. For example, in some implementations, the first set of arcs has 20 teeth, whereas additional sets of arcs have 15 teeth or ten teeth. In some implementations, some of the sets of arcs change both the number of teeth and the distance between the teeth. In some implementations, when there are fewer teeth or the teeth are closer together, the arc itself is smaller (e.g., a 20 degree arc versus a 30 degree arc). In some implementations, a second pair of matching arcs has an arc radius (radius of curvature) that is different from an arc radius of the first upper and lower arcs. When the arcs are detachable, various pairs can be created to accommodate user needs, combining these features, varying the number of teeth, the spacing of the teeth, the radius of curvature, the shapes and sizes of the openings, and so on.

In some implementations, the semicircular concave openings in the first plurality of teeth are sized to fit keratin tips of preformed hair extensions or to fit commercially available keratin beads (which are typically 4 or 5 millimeters across). In some implementations, all of the semicircular concave openings have the same size. In some implementations, all of the semicircular concave openings have the same shape (e.g., like a capital omega Ω). In some implementations, some of the semicircular concave openings on a single upper arc have different sizes and/or shapes.

In some implementations, each groove in the second plurality of teeth is formed by a respective pair of vertical prongs. This creates U-shaped grooves, with either a flat or rounded bottom.

In accordance with some implementations, a method simultaneously attaches multiple hair extensions to a recipient's hair. A user lays out strands of the recipient's hair into a plurality of grooves of a lower arc of a hair extension tool. Generally, the user places a similar number of hair strands into each of the grooves so that they are approximately the same size. In some implementations, the user then places a preformed hair extension with a keratin tip into each of the semicircular concave openings in an upper arc of the hair extension tool. In this case, the grooves with strands of the recipient's hair correspond to the preformed hair extensions in the upper arc. In some implementations, the user places each hair extension (the tip) directly into a groove with a group of strands of the recipient's hair. In some implementations, a user places the hair extensions into the grooves first, and places strands of the recipient's hair second. In some implementations, the keratin tips of the hair extensions are U-shaped, and the strands of the recipient's hair are placed inside the U-shaped keratin tips. In some implementations, when the user brings together the upper and lower arcs of the hair extension tool (e.g., by squeezing upper and lower handles attached to the upper and lower arcs), the tool brings each preformed hair extension in the upper arc into contact with a respective group of strands of the recipient's hair in a groove of the lower arc. The user then activates a heating element in the upper arc (e.g., using a button on the upper handle), thereby melting the keratin tips of the preformed hair extensions and attaching the preformed hair extensions to the recipient's hair. The user then releases pressure on the upper and lower handles to bring the upper and lower arcs apart, and removes the recipient's hair with attached hair extensions from the upper and lower arcs of the hair extension tool.

Implementations use various alternative designs of the arcs and the teeth or grooves in the arcs. In some implementations, the upper teeth have no openings, and press a flat surface against the hair extensions and strands of the recipient's hair to hold them in place while being heated.

In accordance with some implementations, a method simultaneously attaches multiple hair extensions to a recipient's hair. A user lays out a plurality of strands of the recipient's hair into each of a plurality of grooves of a lower arc of a hair extension tool, and places a plurality of hair extension strands into each of the groves that has strands of the recipient's hair. In some instances, the hair extension stands are placed into the grooves before placing the recipient's hair strands into the grooves. The user places keratin beads into semicircular concave openings in an upper arc of the hair extension tool. The grooves in the lower arc correspond to the semicircular openings in the upper arc. The user then brings together the upper and lower arcs of the hair extension tool by squeezing upper and lower handles attached to the upper and lower arcs, thereby bringing each keratin bead in the upper arc into contact with a respective group of strands of the recipient's hair and hair extension strands in a respective groove in the lower arc. The user activates a heating element in the upper arc, thereby melting the keratin beads and attaching the hair extension strands to the recipient's hair. In some implementations, there is also a heating element in the lower arc. The user releases pressure on the upper and lower handles to bring the upper and lower arcs apart, and removes the recipient's hair with attached hair extensions from the upper and lower arcs of the hair extension tool.

In some instances the user is the same person as the recipient (i.e., a person using the tool on her own hair). In some instances, the user is a different person from the recipient (e.g., a salon stylist applying hair extensions to a customer's hair).

Various tools and methods are thus described that facilitate applying hair extensions to a recipient's own hair. The tools and methods create an application process that is both significantly faster and creates more uniform results.

BRIEF DESCRIPTION OF THE DRAWINGS

For a better understanding of the aforementioned implementations of the invention as well as additional implementations thereof, reference should be made to the Description of Implementations below, in conjunction with the following drawings in which like reference numerals refer to corresponding parts throughout the figures.

Reference will now be made in detail to implementations, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details.

DESCRIPTION OF IMPLEMENTATIONS

Figure 1A:
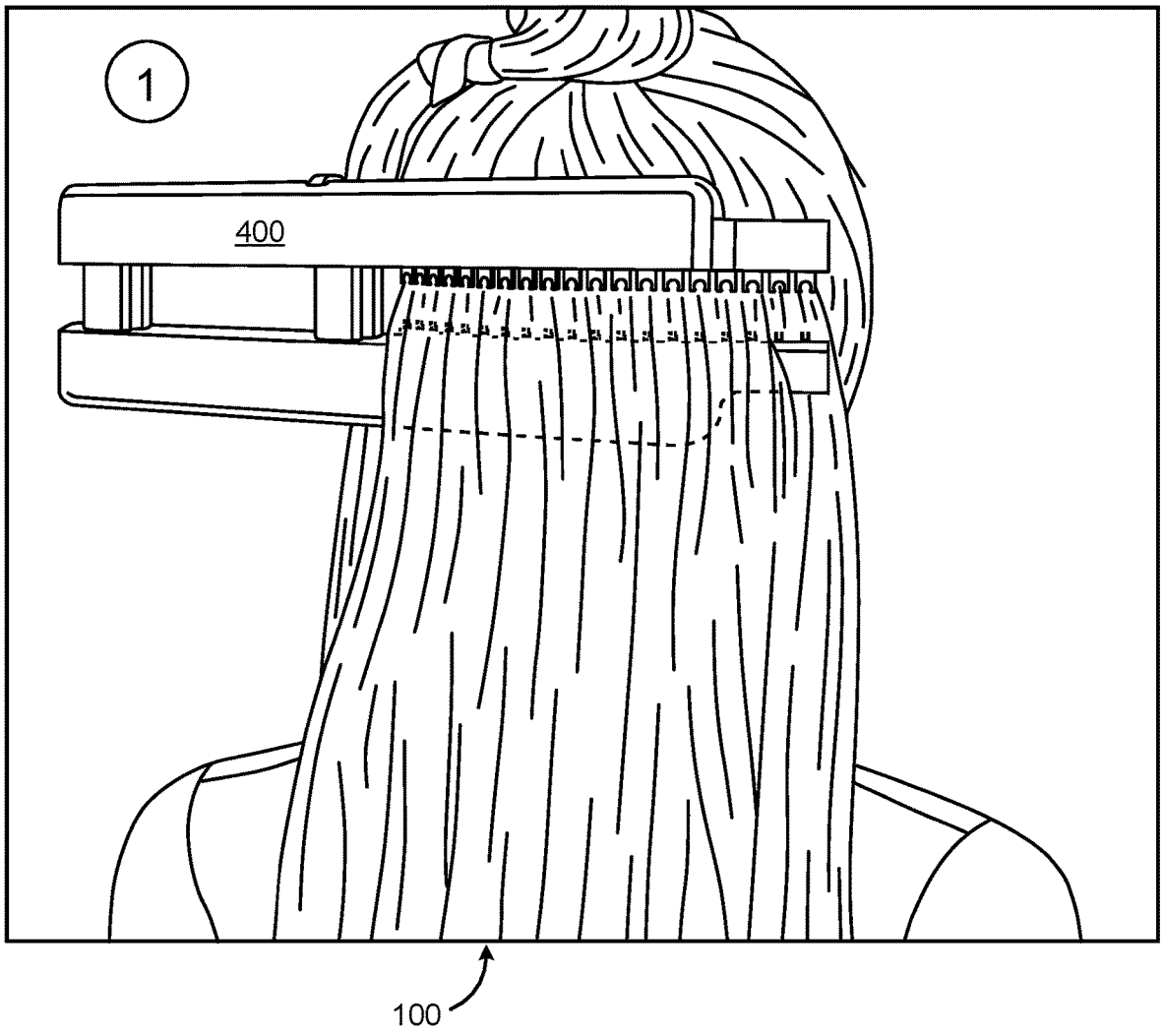
FIGS. 1A-1C illustrate using a tool for attaching multiple hair extensions simultaneously, in accordance with some implementations.
Figure 1B:
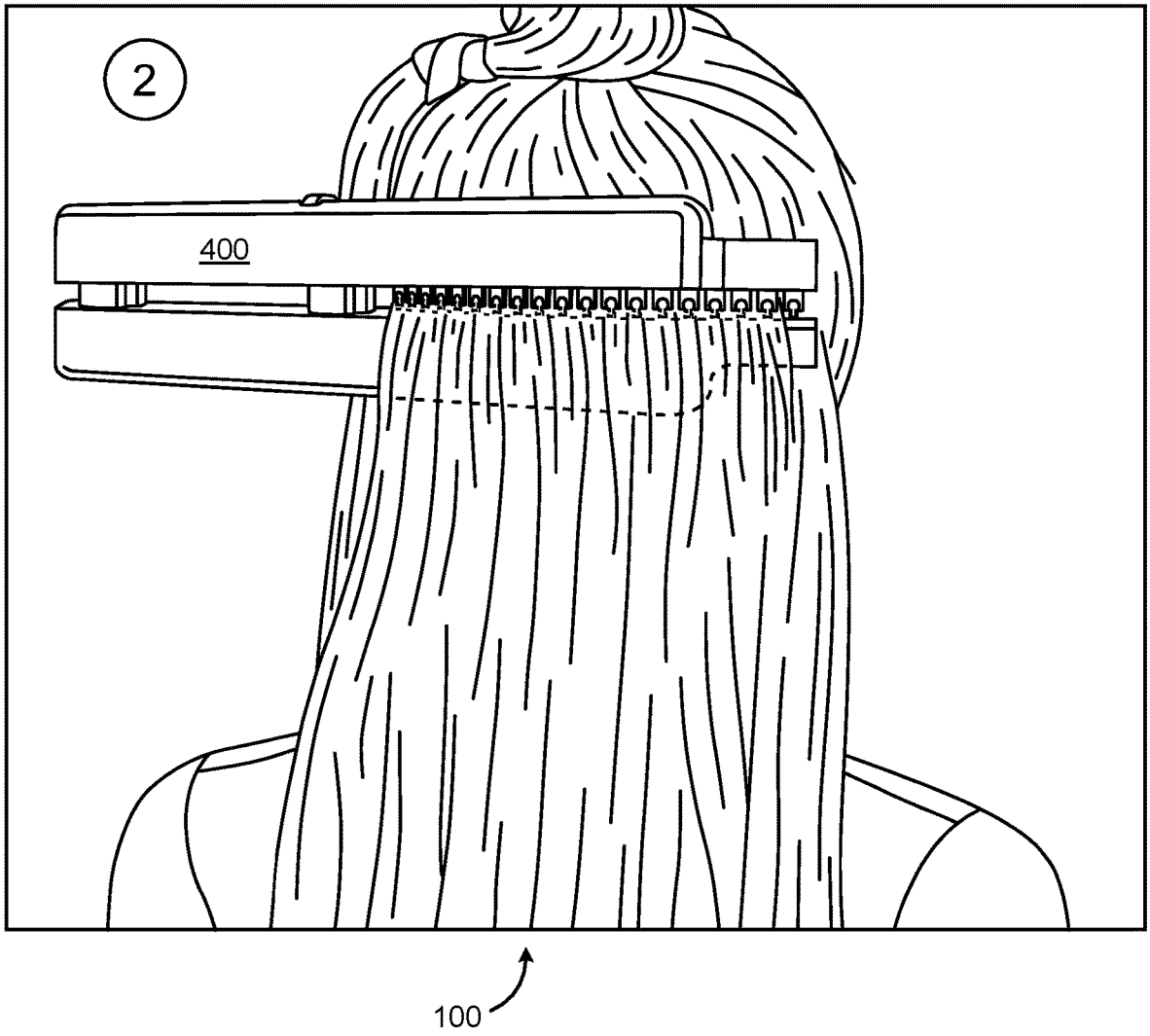
Figure 1C:
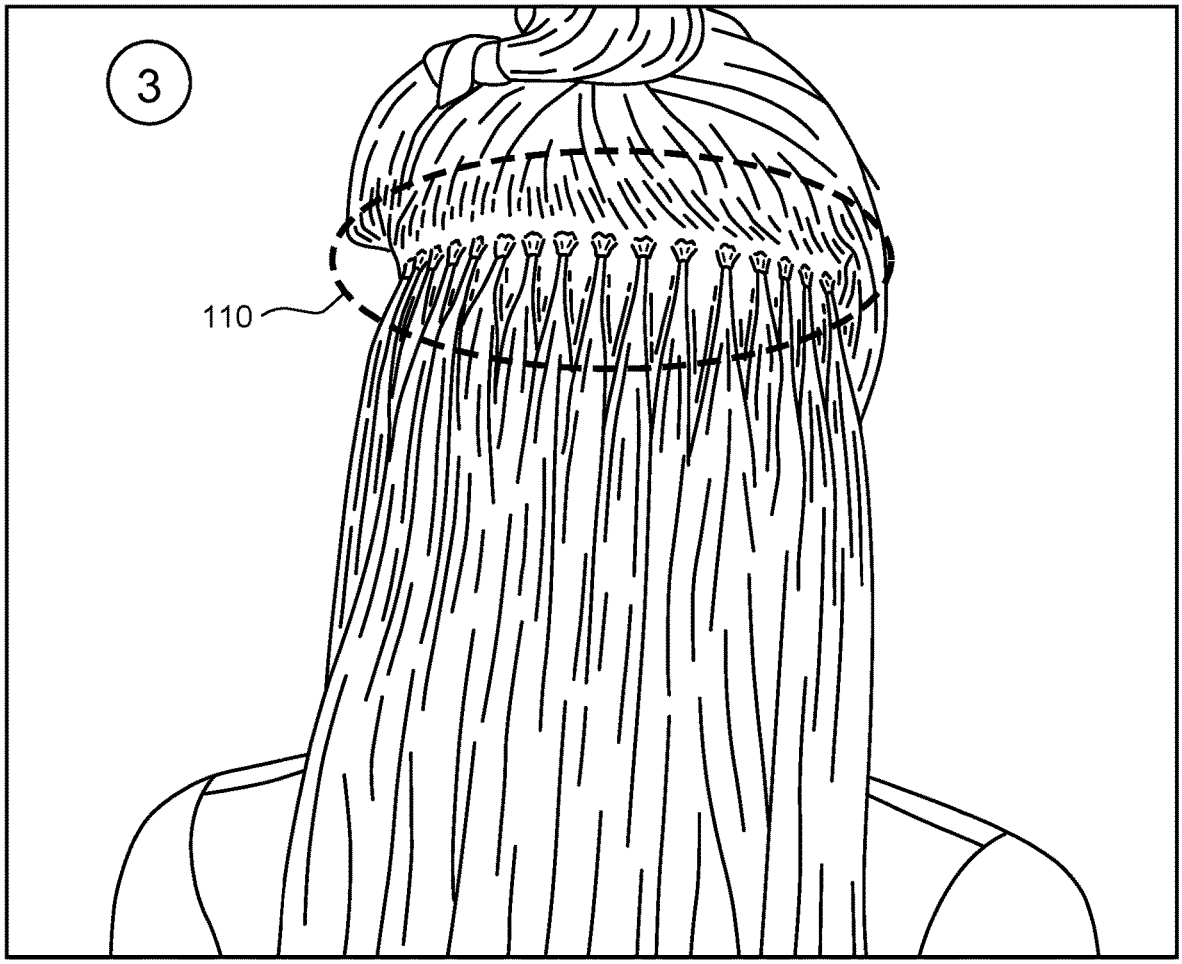
Figure 4A:
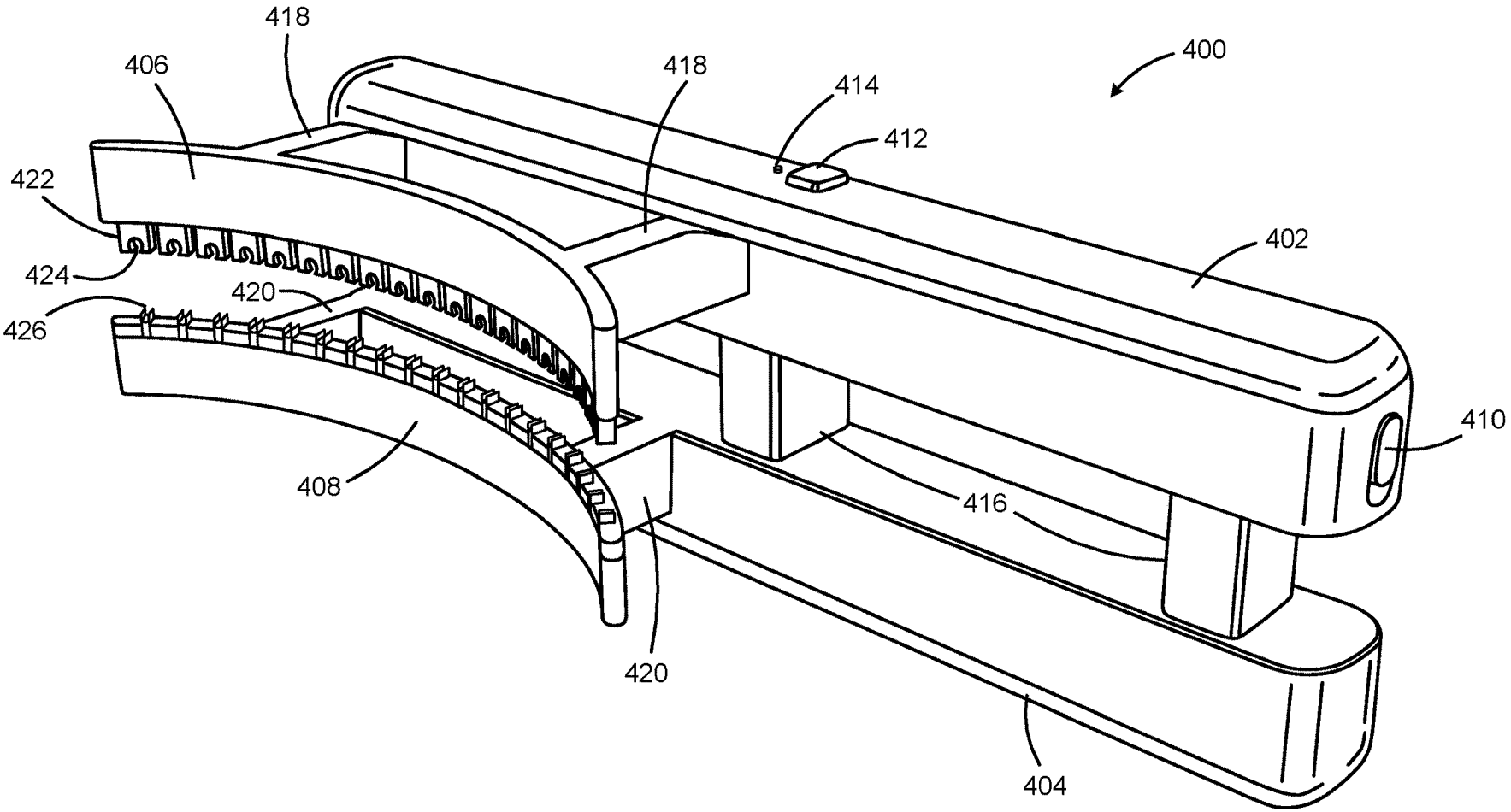
FIGS. 4A-4E illustrate a tool for simultaneously attaching multiple hair extensions, in accordance with some implementations.

FIGS. 1A-1C illustrate using a tool for attaching multiple hair extensions simultaneously, in accordance with some implementations. Here a stylist has combed a recipient's hair 100 into grooves in a lower arc of a tool 400 that can be used to apply multiple hair extensions simultaneously. The recipient's hair 100 is positioned between the upper arc 406 and lower arc 408 of the tool, and between the upper handle 402 and the lower handle 404, as illustrated in FIG. 4A below. As illustrated in FIG. 1B, the tool 400 is closed, thereby compressing the strands of the user's natural hair 100 with strands of the hair extensions. After the tool 400 is closed, the stylist (not shown) activates a heating element (e.g., in one or both the arcs 406 and 408), which melts the keratin tips of preformed hair extensions (or melts keratin beads when not using hair extensions with pre-attached keratin tips). The arcs include thermal protective elements to prevent heating or burning the recipient's scalp. After the keratin is melted, the user deactivates the heating elements and releases the compression on the handles to that the handles 402 and 404 return to the default open state. FIG. 1C illustrates the region 110 of the recipient's scalp after the tool 400 has applied the hair extensions. The tool 400 has created multiple locks of hair in one easy step, and the locks are in a uniform row.

Figure 2:
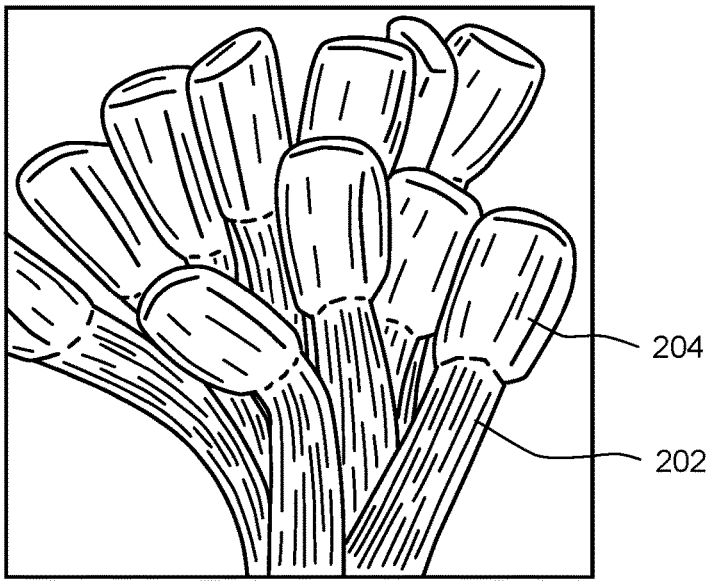
FIG. 2 shows some pre-formed hair extensions with adhesive tips in accordance with some implementations.

FIG. 2 shows some pre-formed hair extensions with adhesive tips (e.g., keratin) in accordance with some implementations. Each hair extension unit includes a bundle 202 of individual hair or fiber strands and an adhesive tip 204 at one end. In some instances, the adhesive tip is made of keratin. In some instances, each tip 204 has a cross-section that looks like the letter "C". When heated (e.g., to 150° C.), the adhesive tip melts, which enables a hair extension to be attached to a person's existing hair. The adhesive tips are commonly 4 or 5 millimeters across, and about 1 millimeter thick.

Figure 3:
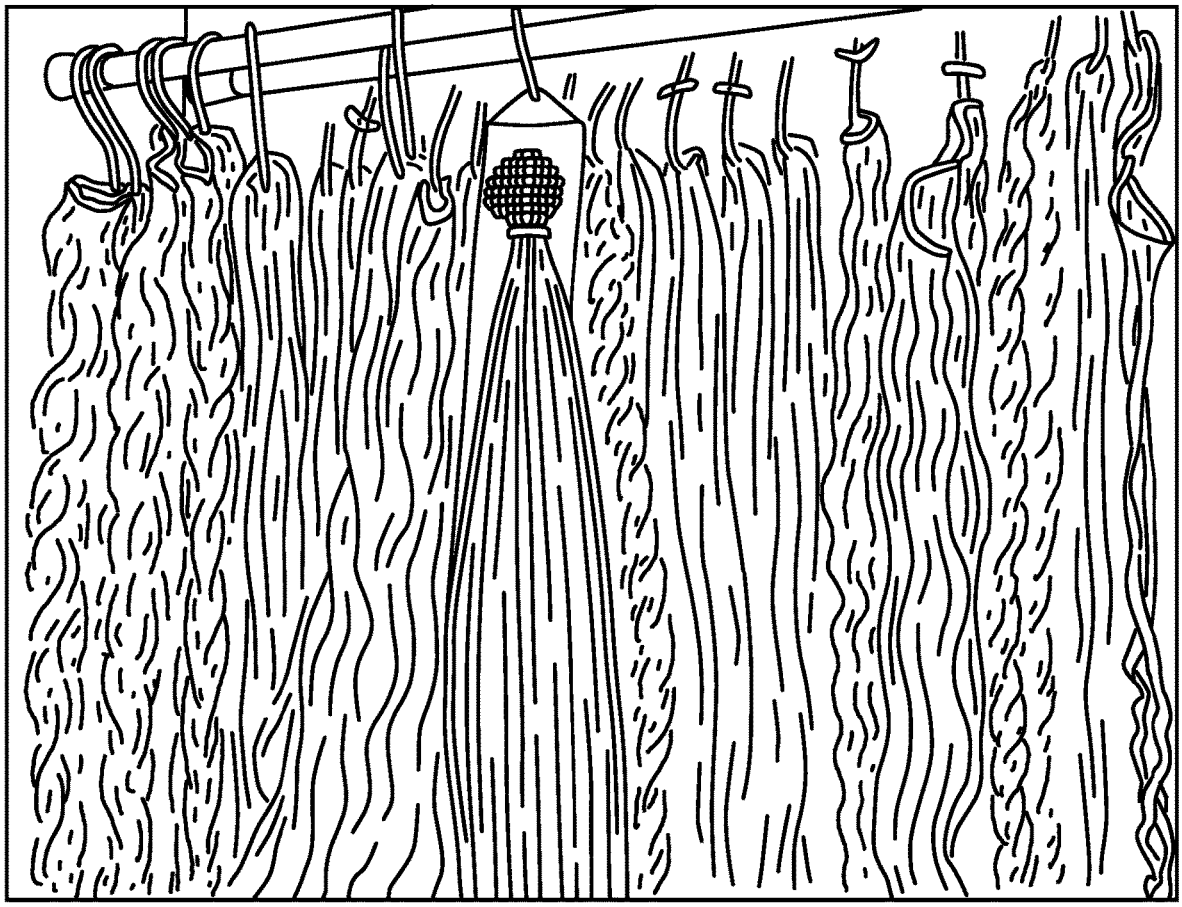
FIG. 3 illustrates an assortment of available hair extensions, in accordance with some implementations.

FIG. 3 illustrates an assortment of available hair extensions, in accordance with some implementations. Hair extensions have different colors, styles, textures, sheen, and lengths. FIG. 3 illustrates both natural hair extensions, obtained from hair donors, and artificial-fiber hair extensions. Hair extensions can be aggregations of individual hairs assembled into a weft, or can be pre-braided. Some of the hair extensions illustrated in FIG. 3 do not have adhesive tips. In this case, a user selects how many strands of the hair extension to use, and typically uses keratin beads to attach the hair extension strands to the recipient's own hair.

FIGS. 4A-4E illustrate a tool 400 for simultaneously attaching multiple hair extensions, in accordance with some implementations. In some implementations, the body of the tool is made of aluminum or other light weight metal. As shown in FIG. 4A, the illustrated tool 400 has an upper handle 402 and a lower handle 404, which are substantially parallel to each other. The two handles are held together by transverse bars 416. FIG. 4A shows the handles in the default open or quiescent position, with the two handles spaced apart. In some implementations, the handles are held in this position by one or more tension strings, which may be located in the handles or in the transverse bars 416. A user can squeeze the two handles together to overcome the force holding the handles in the default position. When squeezed, the handles move toward each other, and maintain a substantially parallel orientation with respect to each other during the movement.

In some implementations, one or both of the handles includes various controls or indicators. In the illustrated implementation, there is a power switch 410 at the rear of the upper handle 402. Typically, implementations also include a power cord, which is not illustrated in FIG. 4A. Other implementations use batteries for power, which may be placed inside the upper handle 402 and/or the lower handle 404.

The illustrated implementation also includes a heating button 412, which is used to activate a heating element in the upper arc 406. In some implementations, heating is initialized when the button 412 is pressed, and the indicator light 414 turns green when the heat reaches an optimal temperature (e.g., about 180° C.). When the button 412 is pressed again, the heating is decreased to a standby mode and the indicator light 414 turns red. Some implementations use a button that is active only while pressed (e.g., a momentary contact switch) so that the heating element turns off when the button 412 is not held. Some implementations also include an indicator light or LED 414, which indicates the status of the device (e.g., whether the device is on or off, or whether the heating element is on or off). In some implementations, the indicator light 414 uses color to indicate status (e.g., no light when the tool is turned off, red light when the tool is heating up, and green light when the heating element is at an optimal temperature).

Attached to the two handles are the upper arc 406 and the lower arc 408. The upper and lower arcs are also referred to as blades. In some implementations, the upper arc 406 is attached to the upper handle 402 by feet 418. Similarly, some implementations attach the lower arc 408 to the lower handle 404 by feet 420. In other implementations, the upper and lower arcs connect directly to the upper and lower handles without the use of connector feet.

Attached to the upper arc 406 is a row of teeth 422, each with a semicircular opening 424. In some implementations, the openings 424 are sized to fit keratin beads or to fit keratin tips (e.g., tips 204) of preformed hair extensions. The lower arc 408 includes a row of grooves 426, which fit into the openings 424 of the row of teeth 422 when the upper arc 406 and lower arc 408 are brought together. In some implementations, there is no spacing between the teeth 422 (e.g., there is a single piece of material). In some implementations, there are no openings 424 in the upper teeth 422. In some implementations, the grooves 426 are larger and/or or spaced closer together. In some implementations, the grooves 426 form a continuous sequence, each connected to the next (e.g., like a sequence of the letter "v" in "vvvvvvvv" or a sawtooth shape). In some implementations, the tool 400 includes multiple sets of arcs with different sized grooves. In some implementations, the groove sizes are micro, mini, standard, and large.

The portions of the upper and lower arcs that come into contact with the recipient's hair are coated with a non-stick surface, such as Teflon®. In the illustrated implementation, the blades are about 2 millimeters wide. Typically, the width is larger, such as 3-10 millimeters.

Figure 4B:
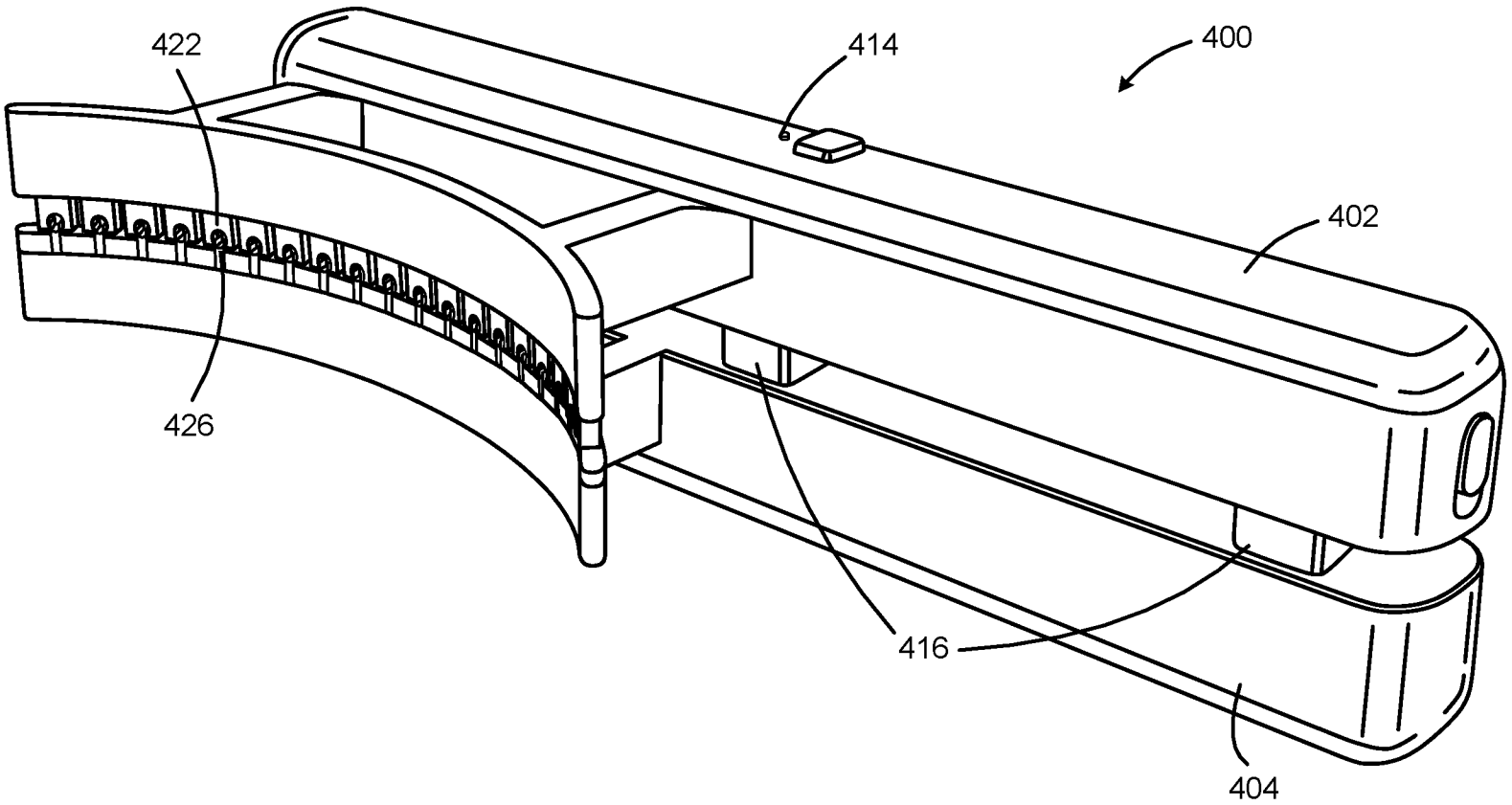

FIG. 4B illustrates the tool 400 when the two handles 402 and 404 are brought together. Note that the indicator light 414 in this figure is green, indicating the heating element (or elements) are at the optimal temperature. When the upper and lower arcs 406 and 408 are brought together, each of the upper teeth 422 is aligned with one of the lower grooves 426.

Figure 4C:
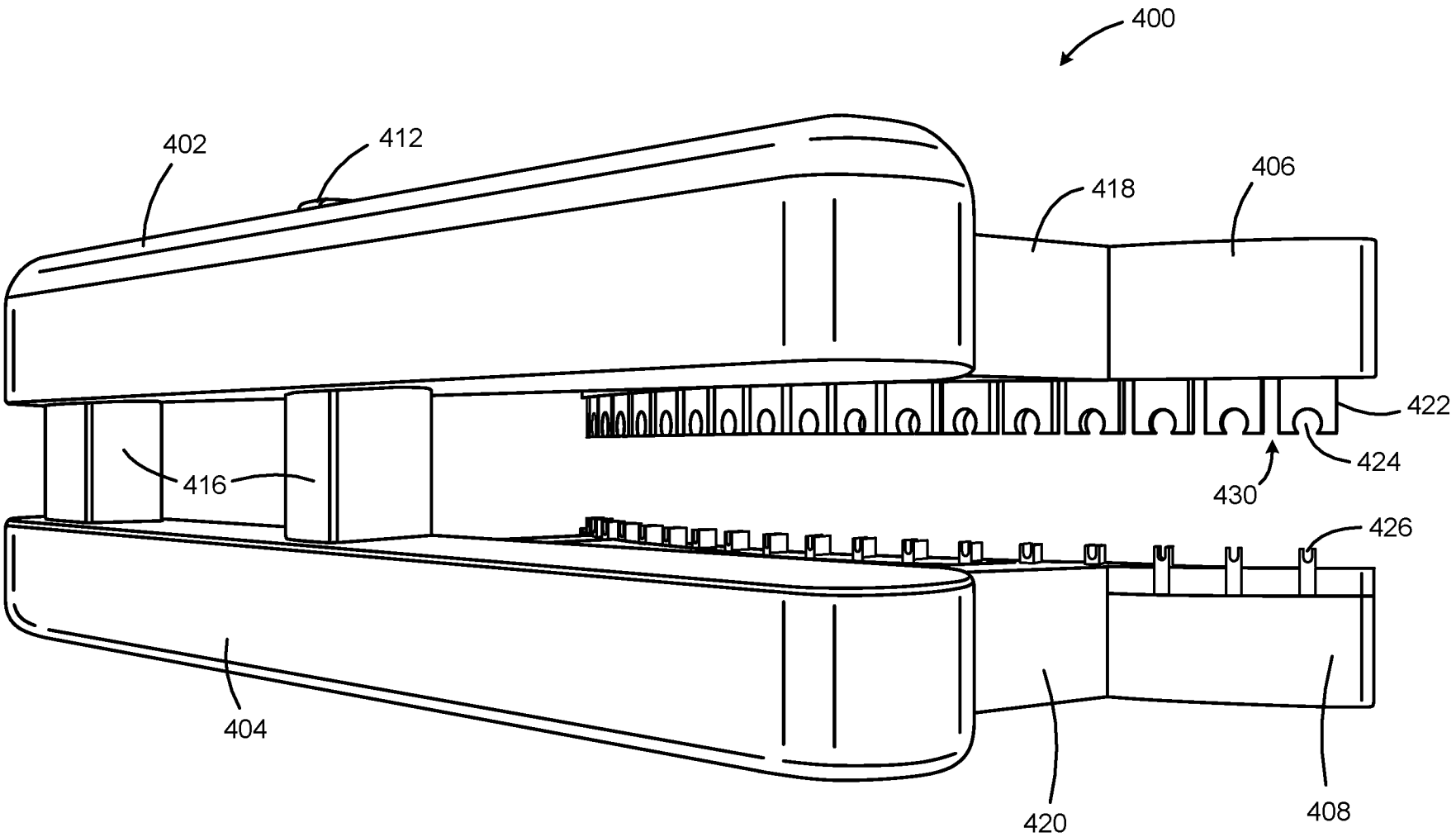
Figure 4D:
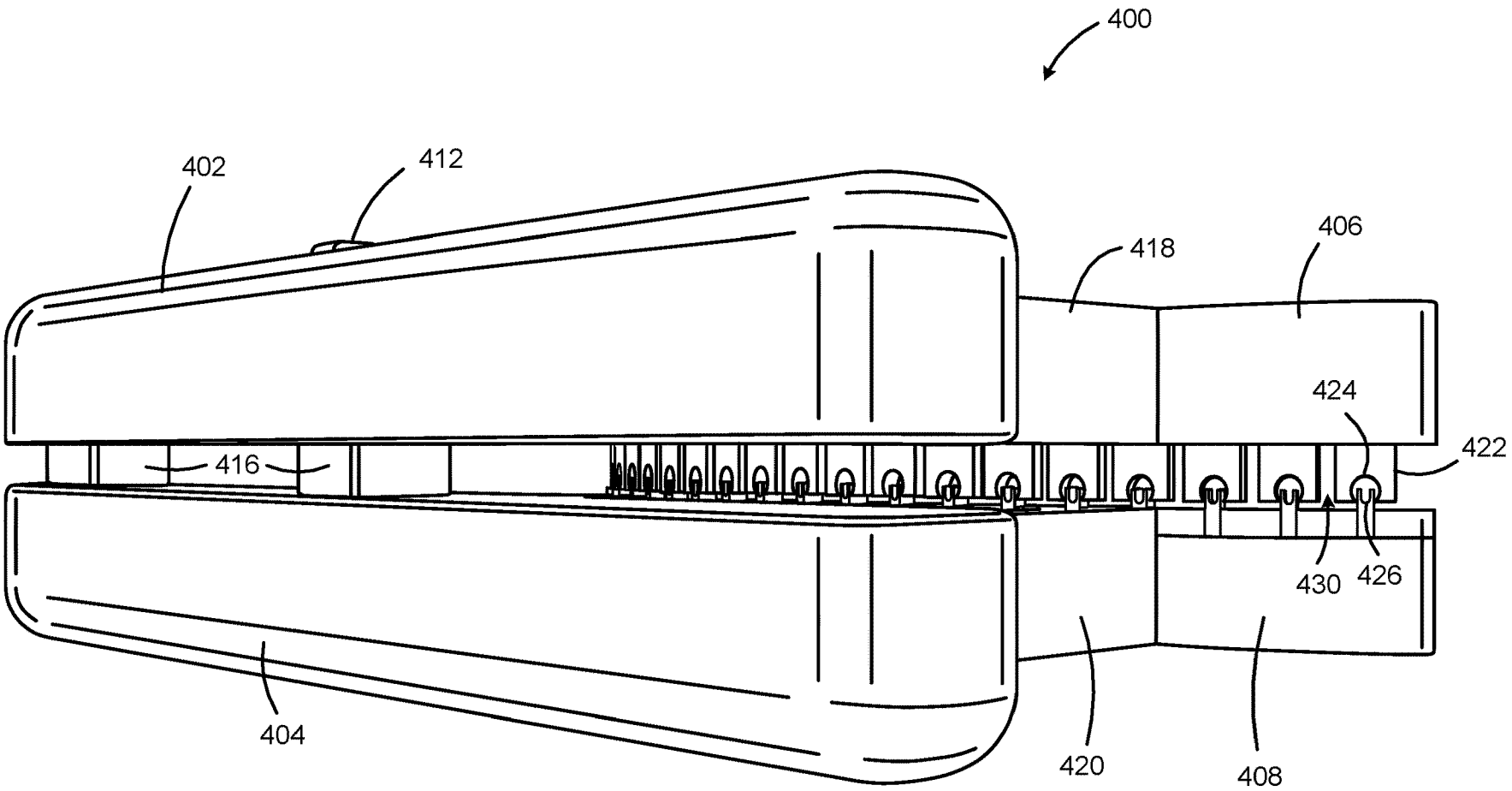

FIG. 4C proves a close up rear view of a tool 400 according to some implementations. FIG. 4C illustrates that the opening 424 in each tooth 422 in the upper arc 406 is aligned with a respective groove 426 in the lower arc 408. In this implementation, there are spaces 430 between the individual teeth 422. However, individually separated teeth are not required. In some implementations, the teeth 422 are all combined as a single piece of material. FIG. 4D is the same view as FIG. 4C, but showing the upper and lower portions after being brought together.

Figure 4E:
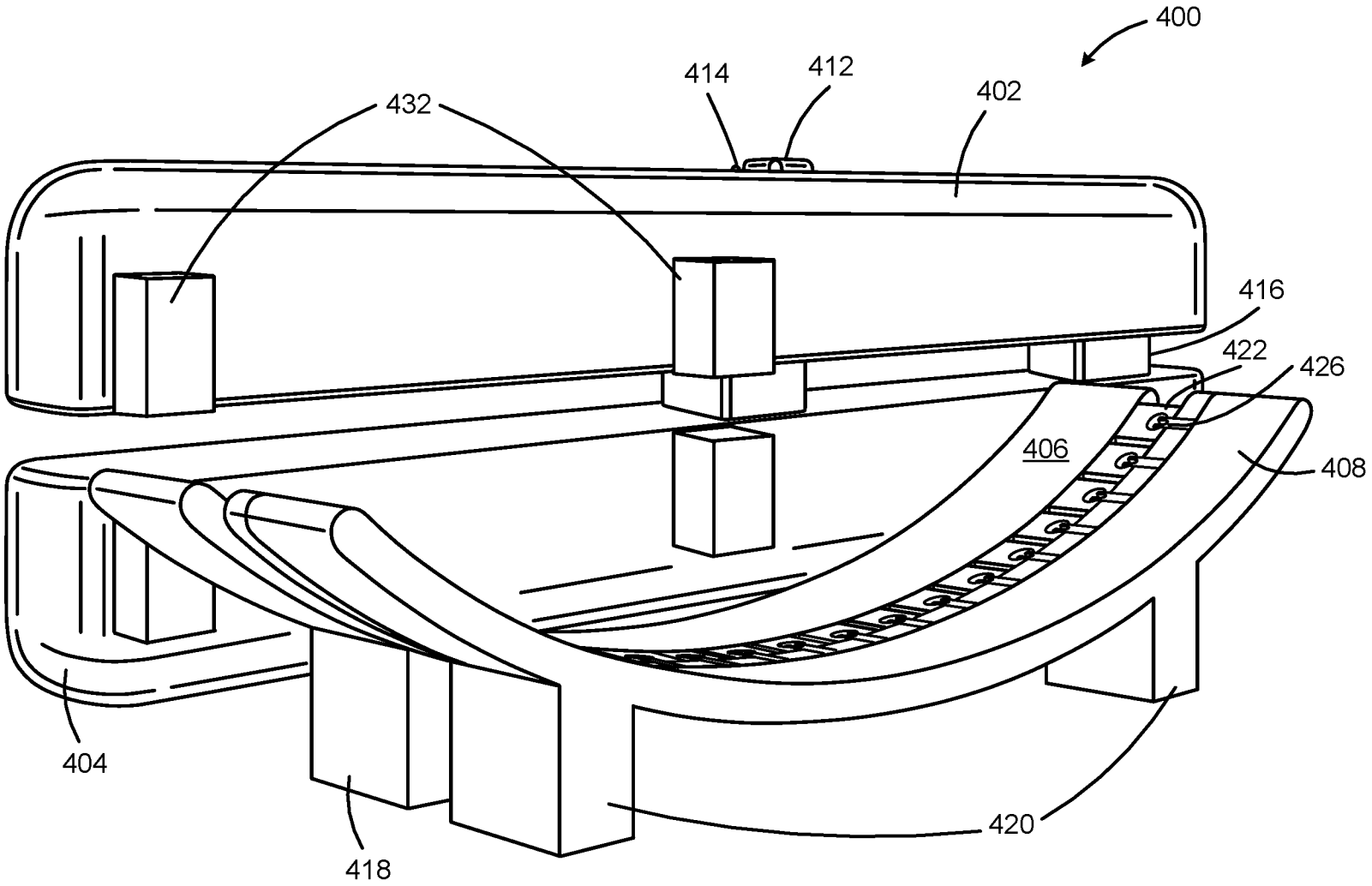

FIG. 4E illustrates that in some implementations the upper and lower arcs 406 and 408 can be removed from the upper and lower handles 402 and 404. The upper and lower arcs 406 and 408 are shown here adjacent to the handles 402 and 404.

Figure 5A:
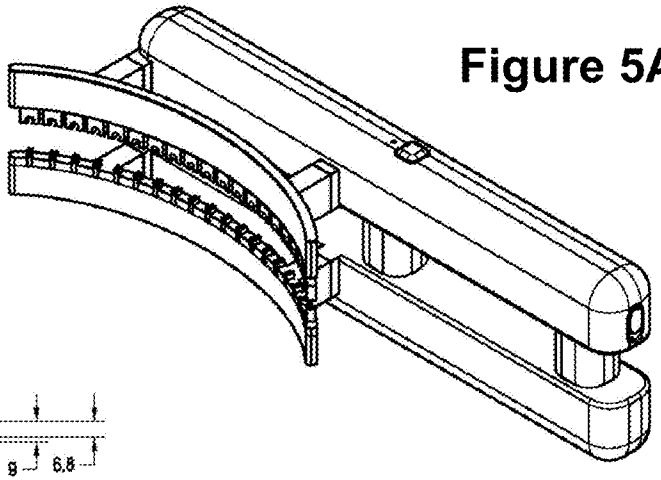
FIGS. 5A-5F provide drawings of a tool for attaching hair extensions, in accordance with some implementations.
Figure 5E:
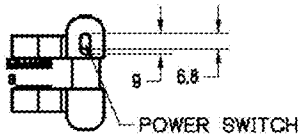
Figure 5C:
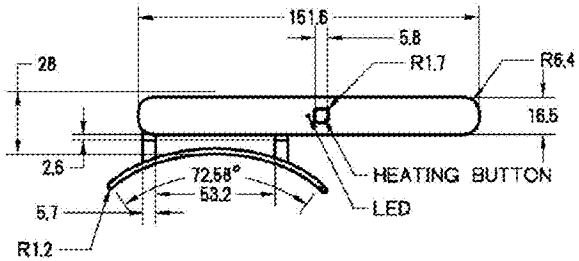
Figure 5B:
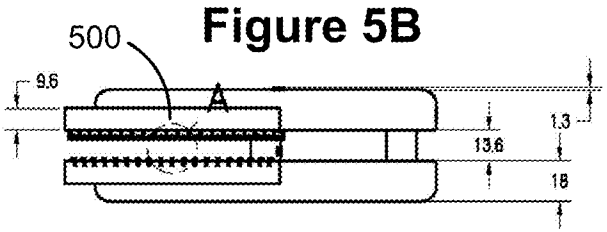
Figure 5D:
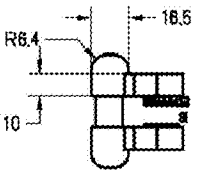
Figure 5F:
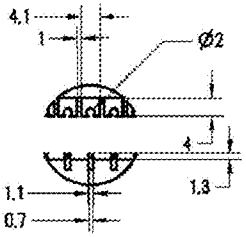

FIGS. 5A-5F provide drawings of a tool 400 for attaching hair extensions, in accordance with some implementations. The drawing in FIG. 5A corresponds to the tool image shown in FIG. 4A. FIG. 5B provides a side view drawing of the tool 400, with a portion 500 identified. The portion 500 in FIG. 5B is magnified in FIG. 5F. FIG. 5C provides a top view drawing of a tool 400, and FIGS. 5D and 5E show the front and back.

Implementations of a tool 400 utilize various tooth and groove shapes and arrangements to accommodate a variety of uses. In some implementations, the tool can be used without heat, fusing strands of a user's hair with hair extension strands using "cold fusion." Cold fusion uses micro link tubes. In this case, after strands of a recipient's hair and strands of the hair extension are inserted into tubes, compression alone is used for fusion. When performing cold fusion, some implementations have an upper arc that is flat (e.g., no openings 424), or an upper arc shape that matches the grooves in the lower arc.

Note that implementations of described hair extension tools can used both by people who are right-handed and by those who are left-handed. Also, the description of "upper" and "lower" arcs can be arbitrary. In some implementations, the upper and lower arcs 406 and 408 are interchangeable. That is, a "lower" arc 408 can fit into the upper handle, and an "upper" arc 406 can fit into the lower handle. In some instances, using an "upper" arc 406 with openings 424 on the bottom can be useful. For example, the semicircular openings 424 hold keratin tips 204 in place, and a recipient's hair is quickly laid out into the keratin tips without moving the hair extensions out of place.

Although specific steps of using a tool 400 to apply hair extensions have been described, one of skill in the art (e.g., a salon stylist) recognizes that many variations are possible with the disclosed versatile tool. For example, the strands of the recipients hair can be placed into the grooves 426 (or openings 424) before or after placing the hair extensions into the grooves 426 (or openings 424). In some implementations, a user specifically places individual groups of hair strands into grooves. Some implementations provide a tooth/groove structure that automatically groups the recipient's hair strands and/or the hair extension strands into the grooves or openings as the handles are brought together. For example, some implementations have a continuous row of v-shaped grooves that hold a keratin tip placed at the bottom of each groove, and as the upper arc is brought down, all of the recipient's hair in the groove is brought into contact with the hair extension.

The terminology used in the description of the invention herein is for the purpose of describing particular implementations only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The foregoing description, for purpose of explanation, has been described with reference to specific implementations. However, the illustrative discussions above are not intended to be exhaustive or to limit the invention to the precise forms disclosed. Many modifications and variations are possible in view of the above teachings. The implementations described herein were chosen and described in order to best explain the principles of the invention and its practical applications, to thereby enable others skilled in the art to best utilize the invention and various implementations with various modifications as are suited to the particular use contemplated.

What is claimed is:

1. An apparatus for simultaneously attaching a plurality of hair extensions to a recipient's hair, comprising:

an upper handle and a lower handle that are mechanically coupled to each other in a parallel orientation, wherein:

the upper and lower handles are moveable with respect to each other;

the mechanical coupling maintains the parallel orientation of the two handles when moved with respect to each other; and the mechanical coupling has a quiescent state in which the upper and lower handles are spaced apart;

an upper arc and a lower arc, each having a convex side and a concave side, wherein:

the upper arc is attached to the upper handle on the convex side of the upper arc;

the lower arc is attached to the lower handle on the convex side of the lower arc;

the upper arc includes a first plurality of teeth, wherein each tooth of the first plurality of teeth has a semicircular concave opening;

the lower arc includes a second plurality of teeth that fit into the semicircular concave openings of the first plurality of teeth in the upper arc when the upper and lower handles are brought together by user action, wherein each tooth of the second plurality of teeth includes a groove for holding a group of strands of the recipient's hair; and the upper arc includes a heating element that is activated by a button on the upper handle or the lower handle.

2. The apparatus of claim 1, wherein the upper and lower arcs are detachable from the upper and lower handles.

3. The apparatus of claim 2, wherein the upper and lower arcs are a first pair of matching arcs of a plurality of pairs of matching arcs.

4. The apparatus of claim 3, wherein a second pair of matching arcs of the plurality of pairs of matching arcs has teeth that are spaced further apart than the teeth in the upper arc.

5. The apparatus of claim 3, wherein a second pair of matching arcs of the plurality of pairs of matching arcs has teeth, consisting of fewer teeth than the teeth in the upper arc.

6. The apparatus of claim 3, wherein a second pair of matching arcs of the plurality of pairs of matching arcs has an arc radius that is different from an arc radius of the upper arc.

7. The apparatus of claim 1, wherein the upper arc is an integrally formed portion of the upper handle, and the lower arc is an integrally formed portion of the lower handle.

8. The apparatus of claim 1, wherein the semicircular concave openings in the first plurality of teeth are sized to fit keratin tips pre-attached to hair extensions.

9. The apparatus of claim 1, wherein the semicircular concave openings in the first plurality of teeth are sized to hold keratin beads.

10. The apparatus of claim 1, wherein each groove in the second plurality of teeth is formed by a respective pair of vertical prongs.

11. The apparatus of claim 1, further comprising a heating element in the lower arc that is activated by the button.

12. A method for simultaneously attaching a plurality of hair extensions to a recipient's hair, comprising:

laying out groups of strands of the recipient's hair into a plurality of grooves of a lower arc of a hair extension tool;

placing a plurality of preformed hair extensions with keratin tips into semicircular concave openings in an upper arc of the hair extension tool, wherein the grooves with groups of strands of the recipient's hair correspond to the preformed hair extensions in the upper arc;

bringing together the upper and lower arcs of the hair extension tool by squeezing upper and lower handles attached to the upper and lower arcs, thereby bringing each preformed hair extension in the upper arc into contact with a respective group of strands of the recipient's hair in the lower arc;

activating a heating element in the upper arc, thereby melting the keratin tips of the preformed hair extensions and attaching the preformed hair extensions to the recipient's hair; and releasing pressure on the upper and lower handles to bring the upper and lower arcs apart, and removing the recipient's hair with attached hair extensions from the upper and lower arcs of the hair extension tool.

13. The method of claim 12, wherein the upper and lower arcs of the hair extension tool are detachable from the upper and lower handles.

14. The method of claim 13, wherein the upper and lower arcs are a first pair of matching arcs of a plurality of pairs of matching arcs.

15. The method of claim 14, wherein a second pair of matching arcs of the plurality of pairs has teeth that are spaced further apart than the teeth in the upper arc.

16. The method of claim 14, wherein a second pair of matching arcs of the plurality of pairs of matching arcs has fewer teeth than the teeth in the upper arc.

17. The method of claim 14, wherein a second pair of matching arcs of the plurality of pairs of matching arcs has an arc radius that is different from an arc radius of the upper arc.

18. The method of claim 12, wherein the semicircular concave openings in the upper arc are sized to fit the keratin tips of the preformed hair extensions.

19. A method for simultaneously attaching a plurality of hair extensions to a recipient's hair, comprising:

laying out a plurality of strands of the recipient's hair into each of a plurality of grooves of a lower arc of a hair extension tool;

placing a plurality of hair extension strands into each of the grooves that has strands of the recipient's hair;

placing keratin beads into semicircular concave openings in the teeth of an upper arc of the hair extension tool, wherein the grooves in the lower arc correspond to the semicircular openings in the teeth of the upper arc;

bringing together the upper and lower arcs of the hair extension tool by squeezing upper and lower handles attached to the upper and lower arcs, thereby bringing each keratin bead in the upper arc into contact with a respective group of strands of the recipient's hair and hair extension strands in a respective groove in the lower arc;

activating a heating element in the upper arc, thereby melting the keratin beads and attaching the hair extension strands to the recipient's hair; and releasing pressure on the upper and lower handles to bring the upper and lower arcs apart, and removing the recipient's hair with attached hair extensions from the upper and lower arcs of the hair extension tool.

20. The method of claim 19, wherein the semicircular concave openings in the plurality of teeth of the upper arc are sized to hold the keratin beads.

* * * * *